US011090955B2

(12) United States Patent
Kwon

(10) Patent No.: US 11,090,955 B2
(45) Date of Patent: Aug. 17, 2021

(54) PORTABLE PRINTER

(71) Applicant: J. STEPHEN LAB., LTD., Osan-si (KR)

(72) Inventor: Sun Tae Kwon, Seoul (KR)

(73) Assignee: J. STEPHEN LAB., LTD., Osan-si (KR)

( * ) Notice: Subject to any disclaimer, the term of this patent is extended or adjusted under 35 U.S.C. 154(b) by 0 days.

(21) Appl. No.: 16/635,541

(22) PCT Filed: Feb. 26, 2018

(86) PCT No.: PCT/KR2018/002321

§ 371 (c)(1),
(2) Date: Jan. 30, 2020

(87) PCT Pub. No.: WO2019/031672

PCT Pub. Date: Feb. 14, 2019

(65) Prior Publication Data

US 2020/0254790 A1 Aug. 13, 2020

(30) Foreign Application Priority Data

Aug. 8, 2017 (KR) ..... 10-2017-0100392

(51) Int. Cl.
*B41J 11/70* (2006.01)
*B41J 3/36* (2006.01)

(52) U.S. Cl.
CPC ..... *B41J 11/70* (2013.01); *B41J 3/36* (2013.01)

(58) Field of Classification Search
CPC ..... B41J 11/70; B41J 3/36
See application file for complete search history.

(56) References Cited

U.S. PATENT DOCUMENTS

2002/0020273 A1 6/2002 Nomura et al.
2005/0123336 A1 6/2005 Oshida et al.
2011/0052299 A1* 3/2011 Nam ..... B26D 1/085 400/621
2017/0275042 A1* 9/2017 Hirose ..... B41J 11/0095

FOREIGN PATENT DOCUMENTS

JP 11-240216 A 9/1999
KR 10-2005-0046645 A 5/2005
KR 10-0944514 B1 3/2010
KR 10-1297646 B1 8/2013
KR 10-2016-0022959 A 3/2016

OTHER PUBLICATIONS

International Search Report of PCT/KR2018/002321 dated May 30, 2018 from Korean Intellectual Property Office.

* cited by examiner

*Primary Examiner* — Matthew Luu
*Assistant Examiner* — Kendrick X Liu
(74) *Attorney, Agent, or Firm* — Revolution IP, PLLC

(57) ABSTRACT

A portable printer according to the present invention includes: a main body part having a paper feeding port and a paper discharge port; a cover part coupled to the main body part to be opened and closed; a cutting part disposed to be adjacent to the paper discharge port and cutting paper discharged from the paper discharge port; and an operating part sliding in at least two directions by an external force so as to operate the cover part or the cutting part.

3 Claims, 7 Drawing Sheets

PORTABLE PRINTER

BACKGROUND

(a) Technical Field

The present invention relates to a portable printer, and more particularly, to a portable printer in which discharged paper is cut by a cutting part provided in the portable printer or a cover part is opened according to the sliding of an operating part.

(b) Background Art

In a point of sale system and an automated recognition system, a printer has been used for printing receipts and labels.

The printer used for the above is generally a thermal transfer printer, and is provided with a cutting device for using continuous paper and cutting outputted paper.

In addition, when the continuous paper fed inside the printer is used up, replacement of the paper is required.

However, in the case of a conventional portable printer using an auto cutting scheme, a power source for automatic cutting is required.

In addition, in such a case, required operating motor and circuit configurations are required to cause a disadvantage, such as the complexity of the product configuration or the rise in product prices.

Further, the scheme has a disadvantage that since a battery is used as a power source of the printer, the scheme is limited in a use environment.

Due to the disadvantages of the portable printer of the auto cutting scheme, a portable printer with a cutting device of a manual cutting scheme is used in some cases.

However, in the portable printer with the cutting device of the manual cutting scheme such as a tear bar scheme, a cutting surface is not clean and dregs of paper generated during cutting are introduced into the portable printer to exert a bad influence on driving the printer, thereby causing a failure of the printer.

Further, since paper should be periodically replaced due to characteristics of the portable printer using continuous paper, the paper needs to be easily replaced.

Accordingly, a method for solving the problems and meeting needs is required.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention has been made in an effort to solve the above-described problems associated with prior art and to provide a portable printer capable of cutting paper discharged by the operation of an operating part.

Further, the present invention has been made in an effort to provide a portable printer provided with a cover part to be opened according to the operation of an operating part.

The objects of the present invention are not limited to the aforementioned objects, and other objects, which are not mentioned above, will be apparent to a person having ordinary skill in the art from the following description.

In order to achieve the objects of the present invention, a portable printer of the present invention comprises a main body part having a paper feeding port and a paper discharge port; a cover part coupled to the main body part to be opened and closed; a cutting part disposed to be adjacent to the paper discharge port and cutting paper discharged from the paper discharge port; and an operating part sliding in at least two directions by an external force so as to operate the cover part or the cutting part.

The operating part may comprise an operating member provided to be adjacent to the paper discharge port; a rotating member rotating in a width direction of the main body part as an axis by sliding the operating member in a first direction; a pressing member sliding by the rotation of the rotating member; and a frame disposed to face the pressing member and rotating by the sliding of the pressing member to open the cover part.

The operating part may comprise an operating member provided to be adjacent to the paper discharge port; a rotating member rotating in a height direction of the main body part as an axis by sliding the operating member in a first direction; and a frame disposed to face the rotating member and rotating to open the cover part.

The operating part may comprise an operating member provided to be adjacent to the paper discharge port; and a frame opening the cover part by sliding the operating member in the first direction.

The cutting part may comprise a first cutter member provided at one side of the paper discharge port; and a second cutter member provided to face the first cutter member and crossing the first cutter member by sliding the operating member in a second direction.

The second cutter member may a protrusion in which a part of a lower portion of a cutter blade of the second cutter member protrudes from a side surface to move in the first direction when the operating member slides by a predetermined distance or more in the first direction.

The second cutter member may have a groove formed at the center of a cutter blade of the second cutter member so that the second cutter member does not completely cross the first cutter member.

Effects of the present invention for solving the above problems are as follows.

According to the present invention, it is possible to easily and quickly open the cover part without a separate process by the operation of the operating part in another direction while cutting clearly the paper to be discharged by the operation of the operating part in one direction.

Further, it is possible to solve a jam phenomenon, in which a cutter blade is caught in the printer, by the operation of the operating part.

The effects of the present invention are not limited to the aforementioned effect, and other effects, which are not mentioned above, will be apparent to a person having ordinary skill in the art from the description of the claims.

BRIEF DESCRIPTION OF THE DRAWINGS

The above and other features of the present invention will now be described in detail with reference to certain embodiments thereof illustrated the accompanying drawings which are given hereinbelow by way of illustration only, and thus are not limitative of the present invention, and wherein.

Figure 1:
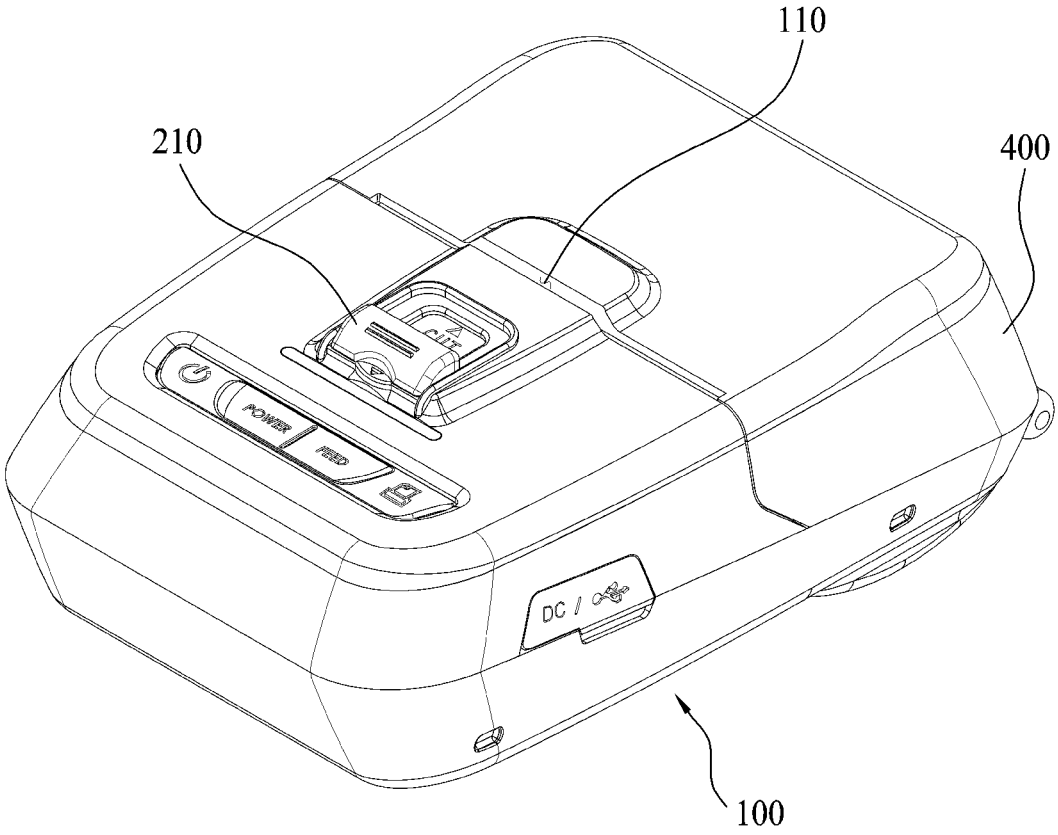
FIG. 1 is a perspective view of a portable printer of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with embodiments, it will be understood that present description is not intended to limit the invention to those embodiments. On the contrary, the invention is intended to cover not only the embodiments, but also various alternatives, modifications, equivalents and other embodiments, which may be included within the spirit and scope of the invention as defined by the appended claims.

Hereinafter, reference will now be made in detail to various embodiments of the present invention, examples of which are illustrated in the accompanying drawings and described below.

First Embodiment

A first embodiment of the present invention will be described with reference to FIGS. 1 to 3.

A portable printer of the present invention includes a main body part 100, a cover part 400, an operating part 200, and a cutting part 300.

The main body part 100 is a portion constituting the main body of the portable printer, and provided with a paper feeding port 120 and a paper discharge port 110.

The paper feeding port 120 is positioned inside the main body part 100 as a portion for storing the continuous paper 10 printed and output by the operation of the printer.

The paper discharge port 110 refers to a portion in which the continuous paper 10 is printed and output to the outside of the portable printer.

The cover part 400 is formed to cover the paper feeding port 120 of the main body part 100.

The cover part 400 is coupled to the main body part 100 so as to be opened and closed, and the cover part 400 is opened when the operating part 200 slides. The structure thereof will be described below in detail.

The operating part 200 is a portion to which an external force is applied by a user.

The operating part 200 may slide in at least two directions by the external force of the user, and the cutting part 300 may be operated by the sliding so that the printed and discharged paper 10 is cut or the cover part 400 is opened.

Figure 2:
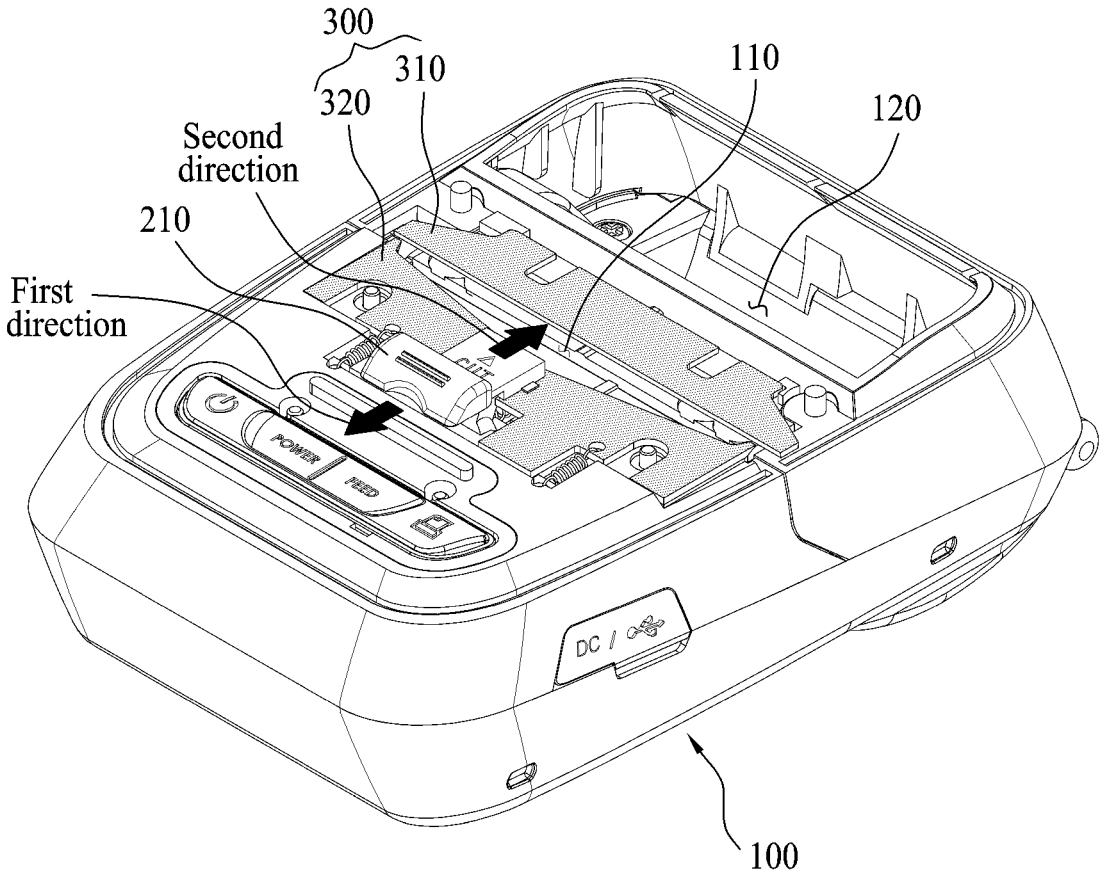
FIG. 2 is a view illustrating a configuration of the portable printer of the present invention.

As can be seen in FIG. 2, during using of the printer, the direction of pulling backward is a first direction, and the direction of pushing forward is a second direction. When the operating part 200 is pulled in the first direction, the cover part 400 is operated and when the operating part 200 is pushed in the second direction, the cutting part 300 is operated.

Unlike a conventional portable printer, the cover part 400 is opened in addition to the operation of the cutting part 300 for cutting the paper 10 by the movement of the operating part 200 having a different direction.

The operating part 200 may be provided to be adjacent to the paper discharge port 110 and disposed on the top of the main body part 100. This is for ease of use of the user.

A structure in which the cover part 400 is opened according to the sliding of the operating part 200 and a configuration thereof will be described with reference to FIG. 3.

The operating part 200 may be provided with an operating member 210, a rotating member 220, a pressing member 230, and a frame 240.

The operating member 210 is a portion to which an external force of the user is applied, and may be provided to slide on a part of the main body part 100. As described above, the operating member 210 may rotate in at least two directions, and may slide in the first direction and the second direction according to FIG. 2.

Figure 3:
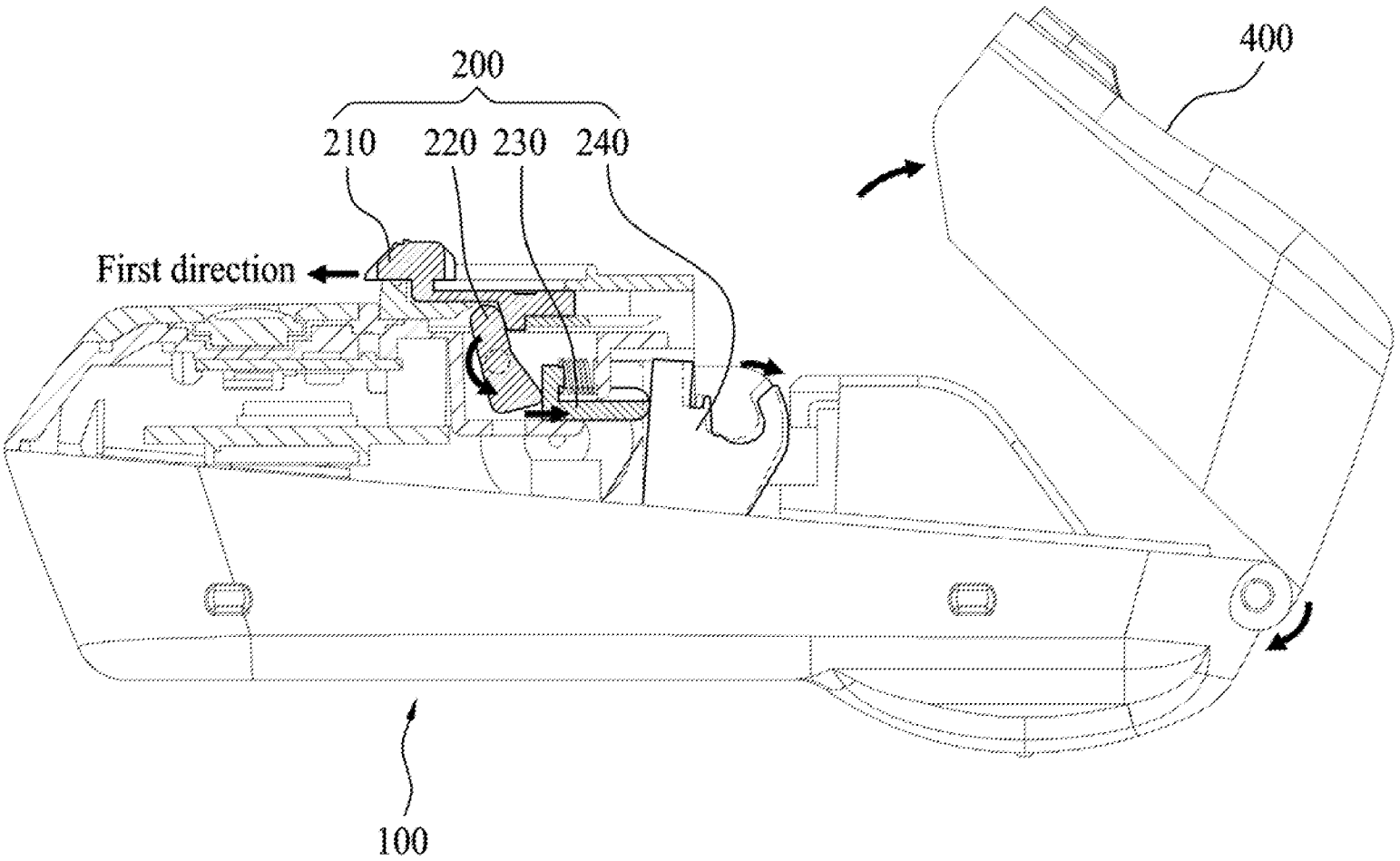
FIG. 3 is a view for a first embodiment of the present invention.

In addition, according to FIG. 3, the operating member 210 may be formed so that a part of a lower surface thereof protrudes. This is to transmit a force to the rotating member 220 to be described below. However, it is not necessary to have a shape as shown in the drawing.

The rotating member 220 may be provided in the main body part 100 to be rotatable in a width direction of the main body part 100.

Accordingly, when the operating member 210 slides in the first direction, the rotating member 220 is rotated by a protruding portion of the lower surface of the operating member 210. That is, the upper end portion of the rotating member 220 is provided to face a portion protruding in a lower direction of the operating member 210.

In addition, when the operating member 210 slides in the first direction, the rotating member 220 may rotate by the lower direction of the operating member 210. Based on FIG. 3, the rotating member 220 rotates counterclockwise to transmit a force to the pressing member 230.

The pressing member 230 is disposed to be adjacent to the rotating member 220 in the main body part 100. In addition, the pressing member 230 may linearly move by the rotation of the rotating member 220.

That is, a lower end portion of the rotating member 220 transmits a force to the pressing member 230 by the rotation of the rotating member 220 so that the pressing member 230 slides.

In addition, when the operating member 210 slides in the second direction, the operating member 210 and the rotating member 220 do not interact with each other. Since one surface of the rotating member 220 is configured to face the operating member 210, the rotating member 220 rotates only by the sliding of the operating member 210 in the first direction. Accordingly, the pressing member 230 moves in a second direction opposite to the sliding of the operating member 210 by the rotational movement of the rotating member 220.

The frame 240 is disposed to face the pressing member 230 and rotatably provided. In addition, the frame 240 is formed to be opened upward, and the frame 240 rotates by the sliding of the pressing member 230 to open the cover part 400.

The cover part 400 is bound to a part of the frame 240 and then released by the rotation of the frame 240 so that the cover part 400 is opened.

That is, the cover part 400 is applied with a force in a direction to be opened by a biasing force of a rotary shaft, but is fastened by the frame 240 when using the printer.

When the user slides the operating member 210 in the first direction, the pressing member 230 slides in the second direction until coming into contact with the frame 240 facing each other, and then transmits a force to the frame 240.

The frame 240 receiving the force is released from the fastening condition by rotating the portion fastened with the cover part clockwise in FIG. 3. Accordingly, the cover part 400 is opened.

In addition, a first elastic member may be provided inside the main body part 100 so as to be connected to the pressing member 230. The first elastic member applies a restoring force to the pressing member 230 so that the operating member 210 slides in the first direction and then returns to a neutral position after the cover portion 400 is opened.

As the pressing member 230 is moved to the neutral position, the rotating member 220 and the operating member 210 also move to a position before the external force is applied and return to the neutral position.

At this time, the elastic member may be inserted and installed between the frame and the member facing each other. The frame may also be restored to a state before receiving the force by the pressing member after rotating by the elastic member.

The cutting part 300 is disposed adjacent to the paper discharge port. Then, the paper 10 discharged from the paper discharge port 110 may be cut by the sliding of the operating part 200.

The cutting part 300 may be provided with at least two cutter members, and cut the paper in such a manner that the cutter members cross each other. However, as long as the cutting part 300 may cut the paper 10, the shape or operation principle of the cutting part 300 is not a problem, and can be applied in various methods.

Since the cover part 400 or the cutting part 300 is operated by the sliding of the operating part 200, a direction in which the operating part 200 slides to operate the cover part 400 may be different from a direction in which the operating part 200 slides to operate the cutting part 300.

Second Embodiment

Figure 4:
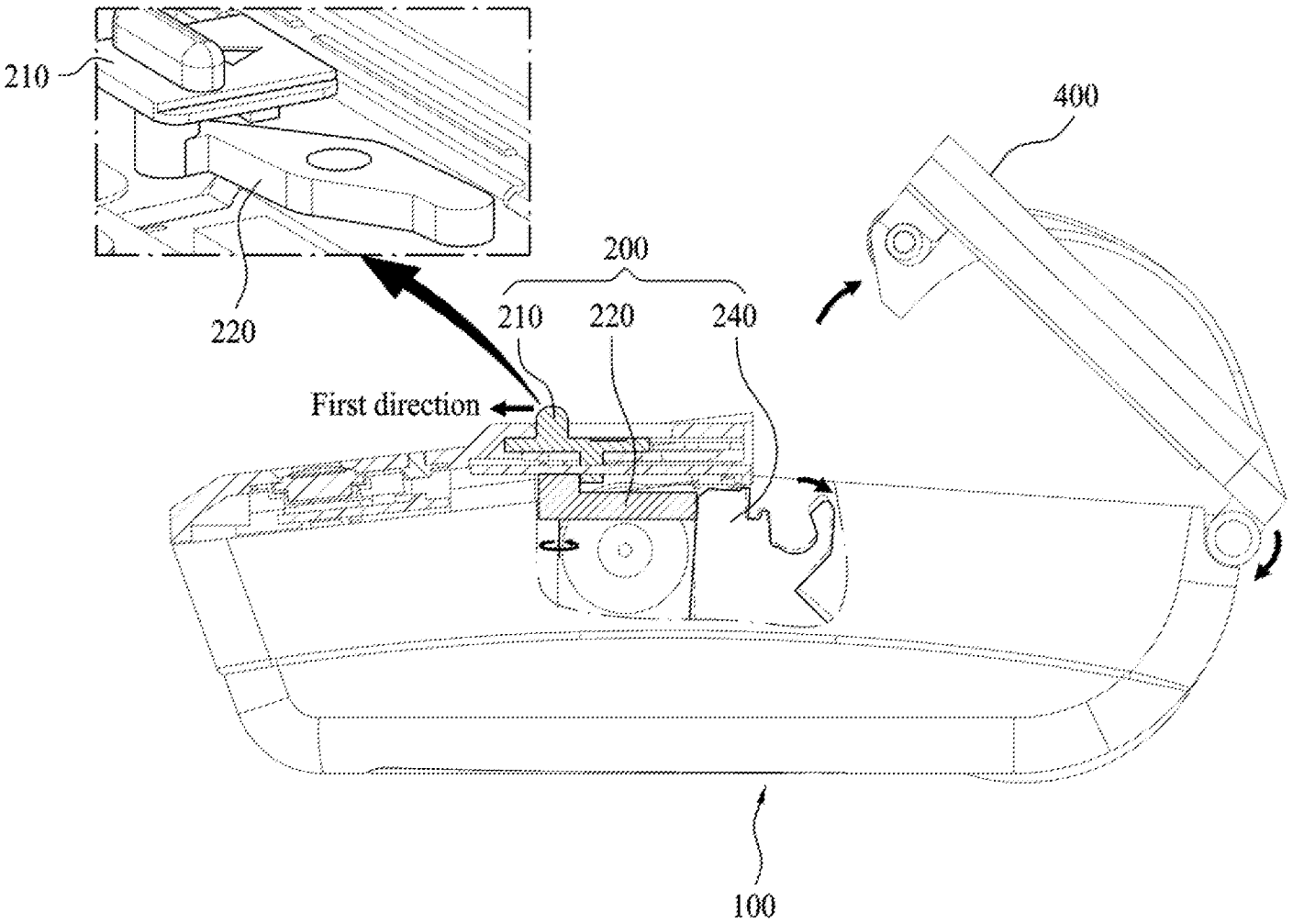
FIG. 4 is a view for a second embodiment of the present invention.

A second embodiment of the present invention will be described in detail with reference to FIG. 4.

The contents omitted in the present embodiment are the same as or similar to the contents mentioned in the first embodiment of the present invention, and those skilled in the art can easily understand and implement the invention by only those described in detail below.

According to the present embodiment, the operating part 200 may be provided with the operating member 210, the rotating member 220, and the frame 240.

The operating member 210 is provided to be adjacent to the paper discharge port 110 and is provided to slide in a first or second direction by receiving an external force.

The rotating member 220 in the present embodiment may be provided to be rotatable in a height direction of the main body part 100 at a lower portion of the main body part 100 on which a second cutter member 320 to be described below is mounted.

When the operating member 210 slides in the first direction, the rotating member 220 is rotated by transmitting a force to a portion in contact with the operating member 210. In addition, the rotating member 220 transmits the force to the frame 240.

The frame 240 is disposed to face the rotating member 220 and rotatably provided. In addition, like the first embodiment of the present invention, the frame 240 is formed to be opened upward, and the frame 240 receives the force by the rotation of the rotating member 220. Then, the cover part 400 is opened by the rotation of the frame 240 receiving the force. The structure is the same as or similar to the first embodiment of the present invention.

Third Embodiment

Figure 5:
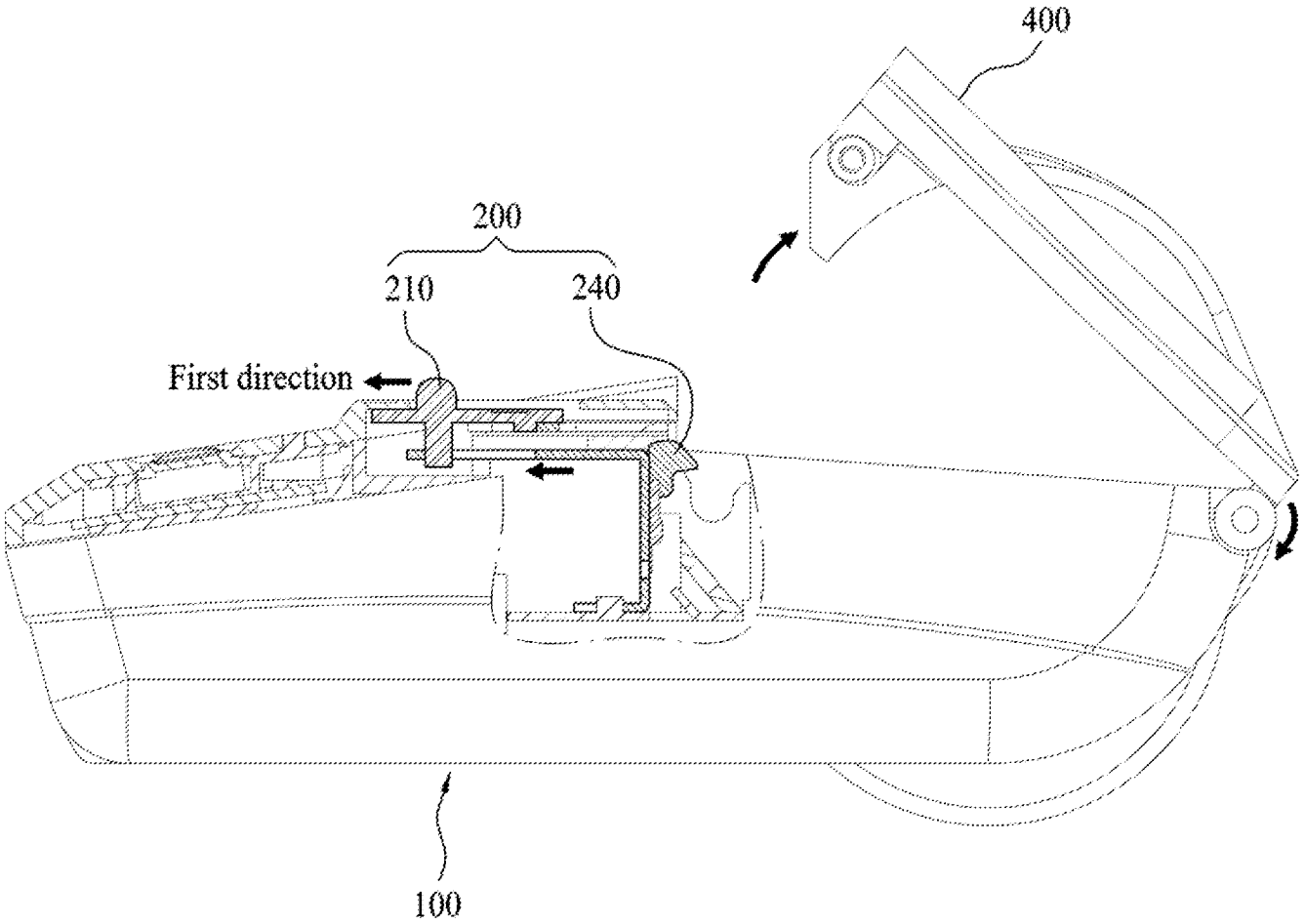
FIG. 5 is a view for a third embodiment of the present invention.

A third embodiment of the present invention will be described in detail with reference to FIG. 5.

The contents omitted in the present embodiment are the same as or similar to the contents mentioned in the first embodiment of the present invention, and those skilled in the art can easily understand and implement the invention by only those described in detail below.

According to the present embodiment, the operating part 200 may be provided with the operating member 210 and the frame 240.

The operating member 210 is provided to be adjacent to the paper discharge port 110 and is provided to slide in a first or second direction by receiving an external force.

The frame 240 in the present embodiment may be elongated so that a part of the frame 240 comes into contact with a portion protruding to the lower portion of the operating member 210. That is, the frame 240 has a shape that is opened downward.

Accordingly, a force is transmitted to the frame 240 when the operating member 210 slides in the first direction. The restraint condition is released by the force received to the portion restraining the cover part of the frame 240 to open the cover part 400.

In other words, the fastening condition is released by the force received to a portion where the frame 240 and the cover part are fastened to each other. Accordingly, the cover part 400 is opened.

Fourth Embodiment

Figure 6:
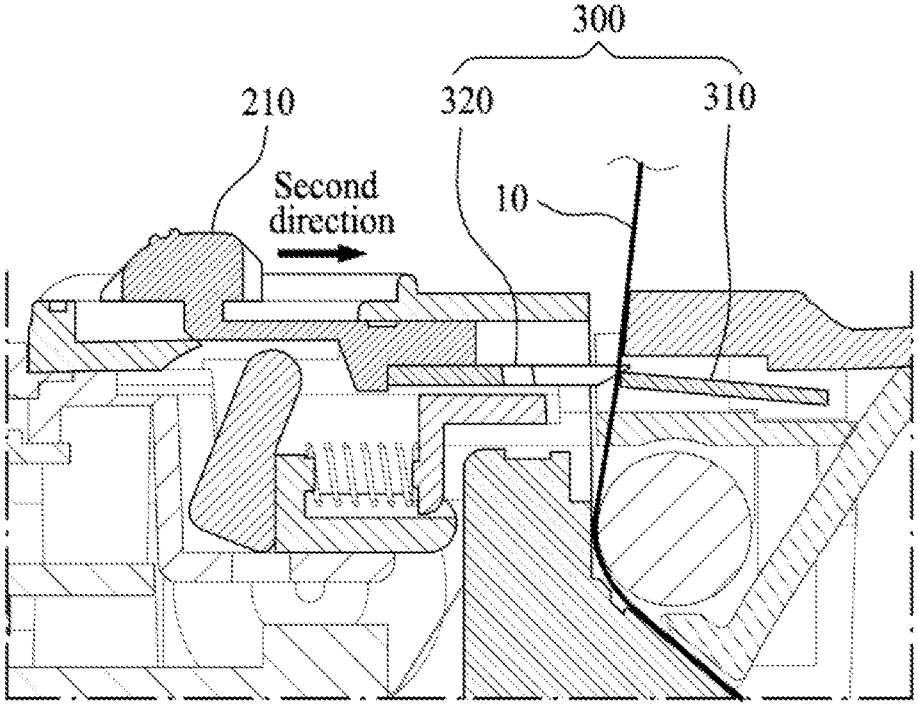
FIGS. 6 and 7 are views for a fourth embodiment of the present invention.

A fourth embodiment of the present invention will be described with reference to FIGS. 5 to 6. In the present embodiment, a process will be described in which the cutting part 300 is operated by sliding the operating member 210 of the portable printer of the present invention in the second direction.

The contents omitted in the present embodiment are the same as or similar to the contents mentioned in the first embodiment of the present invention, and those skilled in the art can easily understand and implement the invention by only those described in detail below.

A cutting part 300 of the portable printer of the present invention may be provided with a first cutter member 310 and a second cutter member 320.

The first cutter member 310 may be provided at one side of the paper discharge port 110 from which the printed paper 10 is discharged, and may have a blade facing the paper discharge port 110.

The second cutter member 320 is provided at the other side of the paper discharge port 110 to face the first cutter member 310.

When the operating member 210 slides in the second direction by an external force applied to the operating member 210, the second cutter member 320 may slide in the same direction by receiving the force of the operating member 210. As shown in FIG. 2, the second direction may be opposite to the first direction.

The second cutter member 320 is positioned so that a part thereof comes into contact with a portion protruding from the lower end of the operating member 210. In addition, one surface of the second cutter member 320 is formed to be inclined on the same plane from the edge to the center portion thereof, and a blade portion is provided in a direction toward the paper discharge port 110 to easily cut the paper by crossing the first cutter member 310.

The operating member 210 slides in the second direction until the second cutter member 320 and the first cutter member 310 cross each other to cut the paper 10.

In addition, in the second cutter member 320, a groove may be formed in the center of a cutter blade of the second cutter member 320. This groove prevents the printed paper 10 from being completely cut. This is to prevent the cut paper 10 from deviating from the operating range of the user when the paper 10 is completely cut.

Specifically, the second cutter member 320 is moved until crossing the first cutter member 310 by an external force applied to the operating member 210. At this time, even if the entire portion other than the groove of the second cutter member 320 crosses a part of the first cutter member 310, the groove portion in the middle of the second cutter member 320 does not cross a part of the first cutter member 310 so that all of the paper 10 is not cut.

Figure 7:
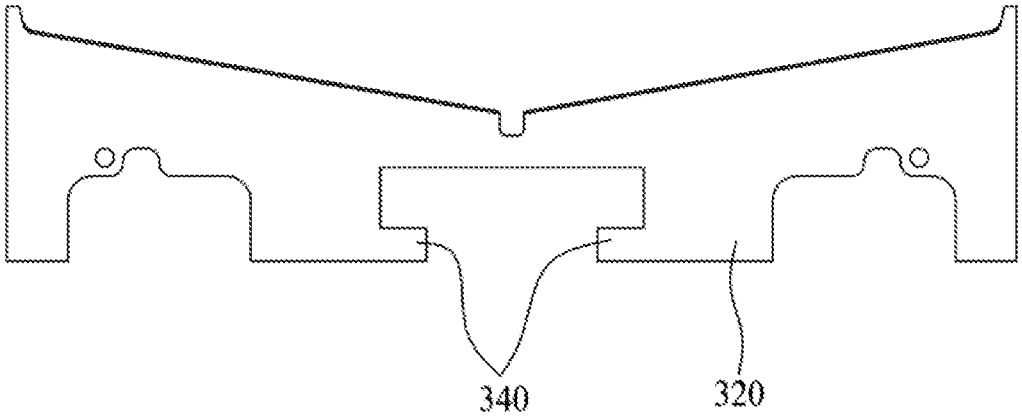

According to FIG. 7, the second cutter member 320 may have a protrusion 340 so that a part of the lower portion of a cutter blade of the second cutter member 320 protrudes in a lateral direction.

In general, the main body part 100 may be connected to the second cutter member 320 and a second elastic member and may be restored to a neutral position after the operating member 210 slides in the second direction by the second elastic member.

However, a so-called jam phenomenon may occur in which the second cutter member 320 does not return to the neutral position after cutting the printed paper 10 by sliding in the second direction.

In order to solve this problem, the protrusion 340 of the second cutter member 320 of the present invention serves to move the second cutter member 320 in the first direction when the operating member 210 slides by a predetermined distance or more in the first direction.

When the protrusion 340 is not formed, the cover member 400 is opened by sliding the operating member 210 in the second direction when the second cutter member 320 does not return to a gravity position due to the jam phenomenon, so that an effort of adjusting the position of the second cutter member 320 is required.

However, when the jam phenomenon and the like occurs due to the protrusion 340 as described above, the operating member 210 slides in the first direction to forcibly return the second cutter member 320 to the neutral position. That is, the protrusion 340 may move in the first direction while engaging with the operating member 210.

As described so far, the portable printer of the present invention has an advantage of having multifunctionality by the sliding of the operating member 210 in at least two directions.

That is, in addition to cutting the printed paper 10 like the related art, the cover part 400 may be easily opened to quickly replace the paper 10 provided at the paper feeding port 120, or even if a jam phenomenon and the like occur in the second cutter member 320, this problem may be solved by the sliding of the operating member 210.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A portable printer comprising:

a main body part having a paper feeding port and a paper discharge port;

a cover part coupled to the main body part to be opened and closed;

a cutting part disposed to be adjacent to the paper discharge port and cutting paper discharged from the paper discharge port; and an operating part sliding in at least two directions by an external force so as to operate the cover part or the cutting part, wherein the operating part comprises:

an operating member provided to be adjacent to the paper discharge port; and a frame opening the cover part by the sliding of the operating member in a first direction, and wherein the cutting part comprises:

a first cutter member provided at one side of the paper discharge port; and a second cutter member provided to face the first cutter member and crossing the first cutter member by the sliding of the operating member in a second direction.

2. The portable printer of claim 1, wherein the second cutter member has a protrusion in which a part of a lower portion of a cutter blade of the second cutter member protrudes from a side surface to move in the first direction when the operating member slides by a predetermined distance or more in the first direction.

3. The portable printer of claim 1, wherein the second cutter member has a groove formed at the center of a cutter blade of the second cutter member so that the second cutter member does not completely cross the first cutter member.

* * * * *